US005378073A

United States Patent [19]

Law

[11] Patent Number: 5,378,073

[45] Date of Patent: Jan. 3, 1995

[54] RING BINDER CARRIER RAIL

[75] Inventor: Chun C. Law, Hong Kong, Hong Kong

[73] Assignee: World Wide Stationery Manufacturing Co., Ltd., Kwai Chung, Hong Kong

[21] Appl. No.: 55,967

[22] Filed: Apr. 30, 1993

[51] Int. Cl.[6] ..... B42F 13/26
[52] U.S. Cl. ..... 402/31; 402/37
[58] Field of Search ..... 402/29, 31, 36–39

[56] References Cited

U.S. PATENT DOCUMENTS

| | | | |
|---|---|---|---|
| 936,448 | 10/1909 | Hamacher | 402/37 |
| 3,246,652 | 4/1966 | Lang | 402/37 |
| 4,368,995 | 1/1983 | Cohen | 402/39 |

FOREIGN PATENT DOCUMENTS

| | | |
|---|---|---|
| 2004816 | 4/1979 | United Kingdom . |
| 2209500 | 5/1989 | United Kingdom . |
| 2255529A | 11/1992 | United Kingdom . |

*Primary Examiner*—P. W. Echols
*Attorney, Agent, or Firm*—Heller, Ehrman, White & McAuliffe

[57] ABSTRACT

A carrier rail for a ring binder which is provided with a plurality of ribs along the longitudinal axis of the rail.

9 Claims, 2 Drawing Sheets

RING BINDER CARRIER RAIL

This invention relates to ring binders which hold paper and the like for loose-leaf binders, files, folders and the like.

Carrier rails in prior art ring binders have the tendency, firstly to be bent when a ring member is attached thereto during assembly, and secondly to twist excessively along the longitudinal axis of the rail when the ring binder is opened and closed.

it is an object of this invention to overcome one or more of the abovementioned problems.

In accordance with the invention, a carrier rail for a ring binder is provided with one or more longitudinal ribs.

Such an arrangement is particularly useful, since the provision of ribs prevents any excessive bending occurring when ring members are attached to the rail during assembly, and secondly prevents any or excessive twisting movement along the longitudinal axis of the rail occurring when the ring binder is actually being opened and closed, thereby allowing for easier closing and opening of the ring members, since the ring binder is more integral.

The bending problem prevents easy assembling of ring binders by machines, and this leads to wastage of rails of at least 17% during the assembly process. It has been found in tests, that with the provision of ribs, no rails are wasted whatsoever.

Holes may be provided in the rail in order to act as guiding means for the rail during actual assembly of the ring binder, and the provision of such holes in the rail makes the twisting effect worse. The provision of the longitudinal ribs on the rail overcomes this additional twisting problem as well.

Suitably a plurality of ribs are provided along the longitudinal axis of the rail.

Suitably these ribs can be the same length or different lengths.

Advantageously the ribs are formed by a pressing function.

Preferably the rib has a base parallel to the rest of the rail, at least one side sloped relative to the rest of rail in the longitudinal direction, and one side sloped relative to the rest of the rail in the transverse direction. Such has the advantage that the center length and width of the rail are effectively made longer and wider due to the indented ribs when compared to a completely flat rail, and accordingly the rail has greater stiffness.

The invention will now be described by way of example with reference to the accompanying drawings in which.

Figure 1:
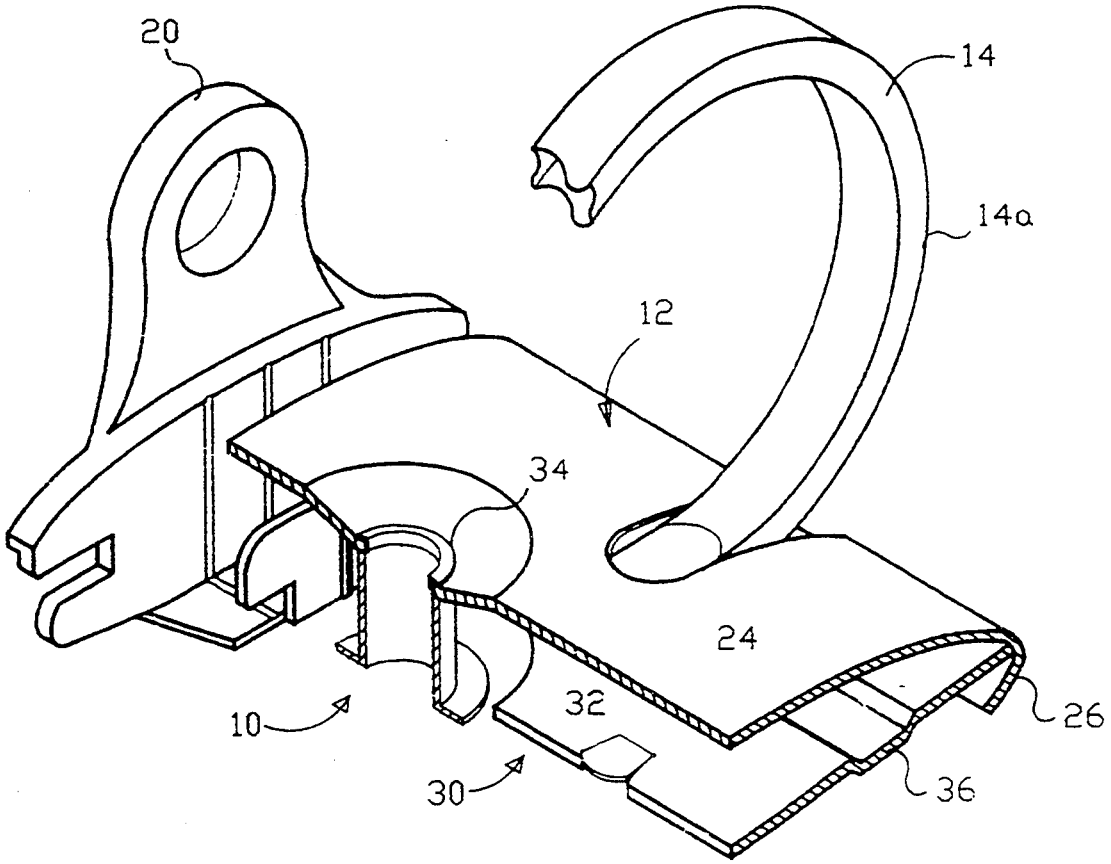
FIG. 1 shows a perspective view of a ring binder in accordance with the invention.

In the drawings a ring binder 10 is shown for a loose-leaf binder comprising a base member 12, three ring members 14 spaced along the base member (only one of which is shown in FIG. 1), and an opening and closing mechanism 20 at each end of the base member (again only one of which is shown in FIG. 1). The base member 12 comprises a housing member in the form of an upper rigid structure 24 which is curved in cross-section and which supports between its two overlapping sides 26 a pivotable lower structure 30 comprising two carrier rails 32 pivotable to each other along the longitudinal axis of the binder 10.

The ring members 14 are mounted on the pivotable lower structure 30 and in particular, one of the ring components (i.e. component 14*a*) of each ring member is mounted on the carrier rail 32 while the other ring component (not shown) of each ring member is mounted on the other carrier rail (also not shown).

Fastening means 34, meanwhile, are also provided on the upper structure 24 in order to secure the ring binder 10 to a paper folder or the like.

The two carrier rails 32 are movable (i.e. pivoted about lugs 35) relative to each other between a lower position and an upper position due to the action of the opening and closing mechanism 20 on each end of the carrier rails.

The opening and closing mechanism 20 is pivotably supported on each end of the upper rigid structure 24 and is in engagement with each end of the pivotable lower structure 30 in order to position the opening and closing mechanism 20 between the upper and lower structures.

Figure 2:
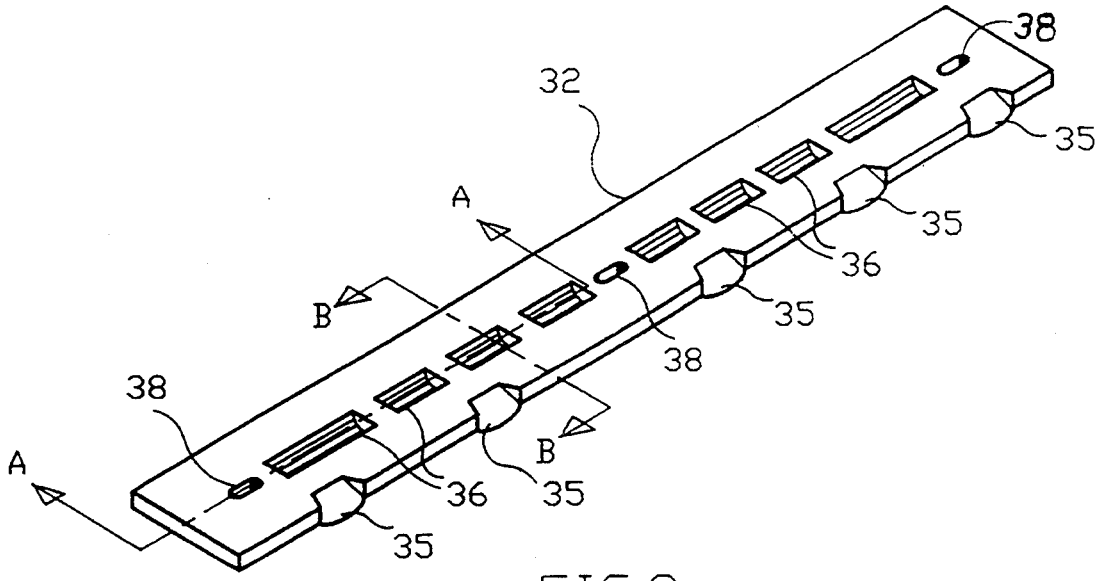
FIG. 2 shows a perspective view or the carrier rail portion of the ring binder shown in FIG. 1.

The carrier rail 32 is shown in greater detail in FIG. 2, and in particular is shown having a number of longitudinal ribs 36 of varying lengths and each of trough-like shape.

Figure 3:
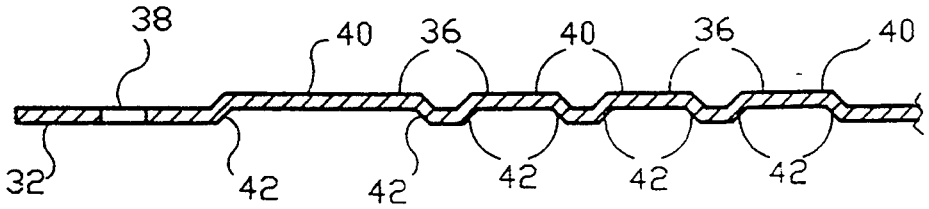
FIG. 3 shows a cross-section of the rail of FIG. 2, as taken along lines A—A of the rail shown in FIG. 2.
Figure 4:
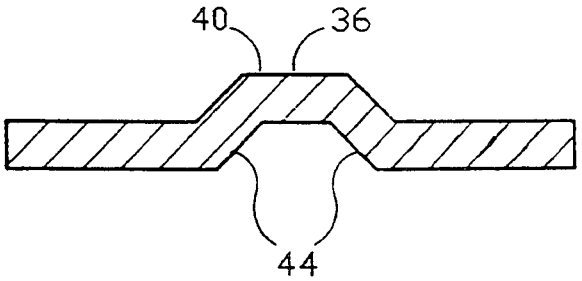
FIG. 4 shows a cross-section of the rail of FIG. 2, as taken along lines B—B of the rail shown in FIG. 2.

It will be noted from FIGS. 3 and 4, that the ribs 36 are deformed and/or pressed relative the rest of the rail 32 such that extra stiffness is provided to the rail. In particular, the base of the ribs 36 is deformed and/or pressed such that it is parallel to the rest of the rail 32. The ribs 36 are also provided with two sides 42 which are sloped relative to the rest of the rail in the longitudinal direction, and two sides 44 which are sloped relative to the rest of the rail in the transverse direction.

Such provides the advantage that it prevents bending of the rail when the ring member 14*a* is attached to a corresponding hole 38 provided in the rail during assembly of the ring binder, and also prevents twisting of the rail 32 during opening and closing of the ring members 14 when the ring binder is in actual use.

Regarding twisting of the rail 32, when the ring binder is forced open at one end, the rails are twisted under torsion, and if the rails are not rigid enough to transmit the torsion to the other end of the binder, the ring members 14 will simply not open. The provision of ribs 36 effectively increases the height of the rails thereby increasing the rigidity of the rail.

A particular advantage of providing the ribs is by increasing the stiffness of the rail, the thickness of the rail can be minimized thereby saving material. In particular, the thickness of each rail can be lowered by 0.1 mm.

It has been found in calculations that the torque increase for the improved rail in the x direction is 1.34% whilst the torque increase for the rail in respect of the y axis direction is 1.3%. The total torque increase for the modified rail compared to prior art arrangements is thus 2.647%, and this is equivalent to a prior art rail with a thickness increased by 1%.

The whole content of the two co-pending patent application Ser. No. 08/055,968 and co-pending patent application Ser. No. 08/056,300, filed on the same day as this case by the same applicant are incorporated into this case by reference thereto.

I claim:

1. A ring binder comprising a housing member, a pair of carrier rails and a plurality of ring members, said housing member supporting said pair of carrier rails which are pivotally mounted relative to each other, at least one of said carrier rails being provided with one or more longitudinal ribs, and each of said ring members being supported by said carrier rails and extending through said housing member.

2. A ring binder as claimed in claim 1 wherein a plurality of said ribs are provided along the central longitudinal axis of the rail.

3. A ring binder as claimed in either claim 1 or 2 wherein said ribs are the same length.

4. A ring binder as claimed in either claim 1 or 2 wherein said ribs are of different lengths.

5. A ring binder as claimed in claim 1 wherein the ribs are formed by a pressing function.

6. A ring binder as claimed in claim 5 wherein the rib is provided with a base which is parallel to the rest of the rail.

7. A ring binder as claimed in claim 5 wherein at least one side of the rib is sloped relative to the rest of the rail in the longitudinal direction.

8. A ring binder as claimed in claim 5 wherein at least one side of the rib is sloped relative to the rest of the rail in the transverse direction.

9. A ring binder as claimed in claim 8 wherein the rib has four sides which are all sloped relative to the rest of the rail.

* * * * *